US008806671B2

(12) United States Patent
Ball et al.

(10) Patent No.: US 8,806,671 B2
(45) **Date of Patent: *Aug. 19, 2014**

(54) CABLE ACTUATED DRAIN

(71) Applicant: WCM Industries, Inc., Colorado Springs, CO (US)

(72) Inventors: William T. Ball, Colorado Springs, CO (US); Eric Pilarczyk, Colorado Springs, CO (US); Kevin Hogan, Prairie Village, KS (US); Carl Riesco, Independence, MO (US); William L. Carlson, Elbert, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/677,841

(22) Filed: Nov. 15, 2012

(65) Prior Publication Data

US 2013/0133135 A1 May 30, 2013

Related U.S. Application Data

(63) Continuation-in-part of application No. 12/830,131, filed on Jul. 2, 2010, now Pat. No. 8,336,132, which is a continuation-in-part of application No. 12/542,205, filed on Aug. 17, 2009, now Pat. No. 8,336,131.

(60) Provisional application No. 61/089,692, filed on Aug. 18, 2008.

(51) Int. Cl.
*E03C 1/232* (2006.01)

(52) U.S. Cl.
USPC ..... 4/683

(58) Field of Classification Search
USPC ..... 4/679–694
See application file for complete search history.

(56) References Cited

U.S. PATENT DOCUMENTS

| | | | | |
|---|---|---|---|---|
| 2,059,120 | A | 10/1936 | Kreuzer et al. | |
| 4,085,469 | A * | 4/1978 | Petursson | 4/684 |
| 4,352,213 | A | 10/1982 | Watts | |
| 4,411,028 | A | 10/1983 | Hogner | |
| 4,594,738 | A * | 6/1986 | Gebert | 4/680 |
| 4,908,883 | A * | 3/1990 | Rivera | 4/689 |

(Continued)

FOREIGN PATENT DOCUMENTS

| | | |
|---|---|---|
| EP | 0322367 | 6/1989 |
| EP | 0322367 A1 * | 6/1989 |

OTHER PUBLICATIONS

International Search Report for International (PCT) Application No. PCT/US2010/045795, mailed Oct. 6, 2010.

(Continued)

*Primary Examiner* — Lori Baker
(74) *Attorney, Agent, or Firm* — Sheridan Ross, PC

(57) ABSTRACT

A drain actuation system that includes a cable to actuate a drain head or stopper is provided. More specifically, one end of the cable is associated with the drain without additional moving parts and another end of the cable associated with an overflow cap of an overflow system wherein rotation of the overflow cap selectively moves the cable to move the head of the drain. The internal components associated with the overflow end of the cable that allow it to actuate the drain are fully accessible through the overflow port of the plumbing system.

14 Claims, 15 Drawing Sheets

(56) References Cited

U.S. PATENT DOCUMENTS

| | | | |
|---|---|---|---|
| 4,910,807 | A | 3/1990 | Willis |
| 5,394,572 | A | 3/1995 | Humphreys |
| 5,590,679 | A | 1/1997 | Almasy et al. |
| 5,692,248 | A | 12/1997 | Ball |
| 5,745,931 | A | 5/1998 | Ball |
| 5,758,368 | A | 6/1998 | Ball |
| 5,890,241 | A | 4/1999 | Ball |
| 6,066,119 | A | 5/2000 | Ball |
| 6,138,298 | A | 10/2000 | Ball |
| 6,142,172 | A | 11/2000 | Shuler et al. |
| 6,148,454 | A | 11/2000 | Ball |
| 6,154,898 | A | 12/2000 | Ball |
| 6,173,459 | B1 | 1/2001 | Ball |
| 6,226,806 | B1 | 5/2001 | Ball |
| 6,317,906 | B1 | 11/2001 | Ball |
| 6,418,570 | B1 | 7/2002 | Ball |
| 6,431,204 | B1 | 8/2002 | Ball |
| 6,546,573 | B1 | 4/2003 | Ball |
| 6,631,623 | B1 | 10/2003 | Ball |
| 6,637,050 | B1 | 10/2003 | Ball |
| 6,640,358 | B2 | 11/2003 | Ball |
| 6,675,406 | B2 | 1/2004 | Ball |
| 6,675,407 | B1 | 1/2004 | Ball |
| 6,681,420 | B1 | 1/2004 | Ball |
| 6,691,411 | B2 | 2/2004 | Ball |
| D521,113 | S | 5/2006 | Ball |
| 7,127,752 | B2 | 10/2006 | Ball |
| 7,185,529 | B2 | 3/2007 | Ball et al. |
| 7,451,502 | B2 | 11/2008 | Ball |
| 7,503,083 | B2 | 3/2009 | Ball |
| 8,028,357 | B2 | 10/2011 | Ball |
| 8,166,584 | B2 | 5/2012 | Ball |
| 8,201,289 | B2 | 6/2012 | Edmonds et al. |
| 8,234,726 | B2 | 8/2012 | Shafik |
| 8,302,220 | B2 | 11/2012 | Ball |
| 8,336,131 | B2 | 12/2012 | Ball et al. |
| 8,336,132 | B2 | 12/2012 | Ball et al. |
| 2004/0068793 | A1 | 4/2004 | Ball |
| 2004/0103474 | A1* | 6/2004 | Ball ..... 4/680 |
| 2004/0111797 | A1 | 6/2004 | Ball |
| 2007/0039098 | A1 | 2/2007 | Ball |
| 2007/0130689 | A1 | 6/2007 | Condon et al. |
| 2008/0047060 | A1 | 2/2008 | Ball |
| 2008/0196161 | A1 | 8/2008 | Ball |
| 2011/0154563 | A1 | 6/2011 | Ball et al. |

OTHER PUBLICATIONS

Written Opinion for International (PCT) Application No. PCT/US2010/045795, mailed Oct. 6, 2010.

Filing of Prior Art Pursurant to Secion 34.1 of the Patent Act for Canadian Patent Application No. 2675721 enclosing a product specification sheet dated Apr. 19, 1985 of Oakvill Stamping & Bending entitled "Bath Waste/Overflows." 8 pages.

International Preliminary Report on Patentability for International (PCT) Patent Application No. PCT/US2010/045795, mailed Mar. 1, 2012.

Official Action for U.S. Appl. No. 12/542,205, mailed Feb, 15, 2012.

Notice of Allowance for U.S. Appl. No. 12/542,205, mailed Oct. 12, 2012 7 pages.

Official Action for U.S. Appl. No. 12/830,131, mailed Jan. 27, 2012.

Notice of Allowance for U.S. Appl. No. 12/830,131, mailed Oct. 26, 2012, 5 pages.

Official Action for Canadian Patent Application No. 2,771,221 dated May 14, 2013, 2 pages.

Notice of Allowance for Canadian Patent Application No. 2,771,221 dated Aug. 6, 2013, 1 page.

Official Action (no English translation available) for Mexican Patent Application No. MX/a/2009/008803 dated Jan. 11, 2013, 2 pages.

Notice of Allowance (no English translation available) for Mexican Patent Application No. MX/a/2009/008803 dated Aug. 16, 2013, 1 page.

* cited by examiner

CABLE ACTUATED DRAIN

This application is a Continuation-In-Part of U.S. patent application Ser. No. 12/830,131, filed Jul. 2, 2010, which is a Continuation-In-Part of U.S. patent application Ser. No. 12/542,205, filed Aug. 17, 2009, which claims the benefit of U.S. Provisional Patent Application Ser. No. 61/089,692 filed Aug. 18, 2008, the entire disclosures which are incorporated by reference herein.

FIELD OF THE INVENTION

Embodiments of the present invention are generally related to devices for facilitating the opening and closing of a stopper or other closure device associated with a drain of a bathtub or other fluid-holding basin. One embodiment of the present invention, specifically, employs a sheathed cable that is associated with a portion of the overflow assembly of a bathtub that actuates a stopper by adjusting a cap of the overflow assembly.

BACKGROUND OF THE INVENTION

A number of cable and chain devices currently exist that allow for manipulation of drain position in a bathtub, a wash-basin, a hot tub, a baptismal, a Jacuzzi-type product, and other similar devices (hereinafter "tubs"). Drain manipulation and control devices that employ chains and cables suffer from problems posed by corrosion, chain tangling, and rigidity issues. These drawbacks of current devices are further compounded by the fact that they are generally inaccessible for repair. As these devices are typically located within the tub or surrounding structure, maintenance or repair thereof is complicated and costly. Typically, unless the original installer provided an access panel, costly removal, replacement, and repair of the stone, tile, or other material surrounding the drain is necessary.

More specifically, attention is directed to U.S. Pat. No. 4,594,738 to Gebert ("Gebert") and U.S. Pat. No. 2,059,120 to Kreuzer ("Kreuzer") that disclose devices that employ a cable to selectively open and close the stopper associated with a drain assembly of a bathtub. More specifically, Kreuzer discloses a handle that is rotatably interconnected by a crank arm to a cable that is positioned within an overflow drain pipe. The overflow drainpipe is also associated with a primary drain system of a bathtub. The cable is also connected to a stud that is associated with a lever that actuates the closure mechanism of the drain. Upon rotation of the handle, the crank arm repositions one end of the cable, thereby rotating the lever to move the stopper out of a strainer body associated with a drain to allow fluid to flow into the primary drain pipe. One drawback of Kreuzer is that the cable is located on the inside of the drain pipe. The problem with this configuration is that the cable cannot be easily adjusted to accommodate overflow assemblies of various lengths. More specifically, manufacturers provide bathtubs of various dimensions. Providing a fixed length of cable as taught by Kreuzer does not allow length adjustment and, thus, may require modification by the installer. The adjustment generally required is in the range of about 6-8 inches but can be much greater. Yet another problem with Kreuzer is that turning of the handle is not efficiently transferred into movement that is needed to turn the lever. This deficiency is related to the fact that nothing is constraining or guiding the movement of the cable. Embodiments of the present invention, which will be described below, include a cable with a constrained cable that is positioned between an overflow elbow and a drain elbow, which eliminates "slop" and provides sufficient force to open the drain stopper.

Similarly, Gebert discloses a system that includes a rotatable linkage associated with the overflow components of a bathtub that is also associated with a bower cable situated on the outside of the overflow drain pipe. Rotation of the linkage moves the cable within its sheath to selectively move closure components associated with the drain portion that move the stopper into and out of the strainer body of the bathtub. One drawback of Gebert is that it includes a bellows portion that does not meet building code requirements. Gebert also mentions that cable twisting caused by a lever associated with the drain is an issue of the prior art.

These examples of the prior art illustrate some of the deficiencies thereof. Namely, the drawbacks of the prior art include the need for complicated drain actuating mechanisms and they suffer from the inability to access all of the internal components of the drain opening system. More specifically, building codes often dictate that such cables and associated components must be accessible by plumbers after the bathtub is installed in order for the plumbers to affect needed repairs. In order to meet this standard, plumbers often must install panels to provide the needed access to the drain portion and the overflow portion of the drain. As will be appreciated by one skilled in the art, the fabrication of these access panels is costly and complicated and may be unsightly.

Thus, it is a long felt need in the art to provide a system that allows for selectively opening and closing a drain stopper of a bathtub without requiring access panels. The following specification describes a system and method that provides a drain actuation mechanism that does not require a person to open and close the drain by pulling on a portion of the drain mechanism that is associated with the bottom surface of the bathtub or basin and that allows enhanced access to all of the components of the drain mechanism from inside the bathtub to facilitate repair without requiring the need of an access panel.

SUMMARY OF THE INVENTION

It is one aspect of the present invention to provide a drain system for use in a bathtub, a hot tub, a baptismal or a Jacuzzi (hereinafter "a bathtub"). Drain systems have two main branches, a primary drain system and an overflow system that are interconnected into a wastewater line. With reference to FIG. 1, bathtubs commonly employ an overflow port and a drain port. The overflow port is often associated with an overflow cap that hides an overflow pipe associated with the overflow port. The drain port is associated with a strainer body that interconnects to a drain pipe to the bottom portion of the bathtub. In operation, the drain is closed and the bathtub is filled with water. The drain is usually manually blocked by a plug that maintains fluid in the bathtub. If the water level reaches the overflow port, some excess water will flow therethrough. These systems are well known and described in detail in the applications and patents referred to above.

It is thus one aspect of the present invention to provide an overflow port having a rotatable cover or other mechanism that is associated with a cable that is also associated with the drain. More specifically, one embodiment employs an overflow cap that is rotated to selectively close or open the drain. Another embodiment of the present invention employs a mechanism, such as a flipper switch, that moves the cable. Such a system is aesthetically pleasing as the components associated with drain operations are concealed and are thus different from drain systems of the prior art that employ a stopper with a chain, a knob or other flip type switch that is used to open or close the drain. The contemplated system is also desirable since it alleviates the need for one to place his or her hands within often dirty waste water to remove the plug, for example, to open the drain. This aspect of the present invention will be appreciated by those in the medical field, for example, where basins or sinks may additionally include dangerous materials.

It is another aspect of the present invention to provide a drain system that does not require an access panel to reach the cable and associated components. It will be appreciated that such a system will reduce costs and complexity associated with a bathtub installation. That is, the need to accommodate the access panel or to repair stone, tile, or other similar materials associated with a bathtub are alleviated. The cable and associated components of one embodiment of the present invention may be repaired from inside the bathtub by way of the overflow port. More specifically, to facilitate repairs the cover of the overflow system and/or drain is removed to reveal the inner workings of the drain actuating system, which can then be easily replaced.

It is another aspect of the present invention to provide a system that can be pressure tested. As disclosed in various patents and issued publications listed above related to overflow assemblies, embodiments of the present invention include a mechanism to selectively obstruct flow of water through the overflow system. That is, it is often required or desirable to test a plumbing system by blocking overflow ports, drains and inlets to the basin by filling the plumbing system of a house with water or air to assess leakage of any of the components. In order to facilitate these tests, the overflow port, for example, is often plugged with a balloon or a cap. One embodiment of the present invention, however, includes a diaphragm that is associated with the overflow port. After all testing is completed, the thin diaphragm is removed and discarded. This type of diaphragm helps address complexities of pressure testing a plumbing system and thus reduces costs. One of skill in the art will also appreciate that a plug, cap, or other flow preventing device may be employed instead of the diaphragm without departing from the scope of the invention.

It is another aspect of the present invention to provide a drain actuation mechanism that does not use and is devoid of complicated linkages taught by the prior art, for example. More specifically, embodiments of the present invention employ a cable that is associated on one end to the cap of an overflow drain and associated on a second end with a drain stopper wherein rotation of the cap moves the second end of the cable to selectively move the drain stopper. Thus, this embodiment of the present invention alleviates the linkages, levers, or the like associated with the drain portion of the plumbing system disclosed by the prior art described above. In this configuration, the cable is also not necessarily rigidly secured to an actuation mechanism and is free to twist, a feature not found in the systems of the prior art where cable twisting was identified as a detriment. One skilled in the art will appreciate that the second end of the cable could also be moved by trip levers, flip levers, push-pull devices, push buttons, etc., without departing from the scope of the invention.

It is another aspect of the present invention to employ a cable that is made of plastic instead of a braided or solid metal cables. Preferably, such cables are lighter, more flexible and corrosion resistant than metal cables.

It is yet another aspect of the present invention to provide an overflow cap having a handle or knob associated therewith that facilitates rotation thereof. Such a device would be ideal to be used by individuals of limited dexterity, such as the elderly or handicapped.

Thus, it is one aspect of the present invention to provide a system for controlling a drain valve that comprises an overflow conduit with a plate having an aperture therethrough. In one embodiment, a shaft is rotatably positioned within the aperture and employs a linkage that is associated with the first end of the cable. The cable has a first end and a second end wherein the first end is interconnected to the linkage such that rotation of the shaft moves the linkage, and thus the first end of the cable, from a first position to a second position along a generally arcuate path. One of skill in the art will appreciate that the cable may be associated with the shaft in other ways wherein the first end of the cable does not move along an arcuate path. The movement of the second end of the cable opens and closes a drain valve associated with the drain conduit. A cap may also be included that is rotatably associated with the overflow port and associated with said shaft such that rotation thereof moves the cable between the first and second positions. Such embodiment may also include a sheath that is associated with the overflow conduit and a drain conduit that accommodates the cable.

It is yet another aspect of the present invention to provide a system of controlling a drain valve that is associated with an overflow conduit and a drain conduit. In certain embodiments a sheath is associated with the overflow conduit and the drain conduit that houses a cable. The cable has a first end associated with the overflow conduit and a second end associated with the drain conduit. In this embodiment, the first end is accessible by way of an opening in said overflow conduit and the second end is accessible by way of an opening in the drain conduit.

It is yet another aspect of the present invention to provide a system that is field testable. More specifically, embodiments of the present invention employ an overflow assembly that includes a diaphragm. For example, contemplated overflow assemblies are disclosed in Applicant's U.S. patent application Ser. Nos. 09/593,724 and 12/057,660; U.S. Pat. Nos. 6,691,411, 6,675,406, 6,637,050 and 7,127,752; and U.S. Patent Application Publication Nos. 2004/0117907, 2004/0068793 and 2004/0111797, the entire disclosures which are incorporated by reference herein. In operation, the plumbing system associated with the cable actuated drain assembly is tested and the diaphragm associated with the overflow port is removed in some fashion subsequently thereto. For example, the diaphragm may be removed, either partially or completely, by cutting or peeling it away from the overflow assembly to thereafter allow flow of water through the cable actuated drain assembly.

It is another aspect of the present invention to provide a cable actuated drain assembly that provides a gap between the bathtub and the overflow cap. More specifically, embodiments of the present invention employ at least one adapter that spaces the overflow cap from the bathtub, thereby providing a continuous or semi-continuous opening around the overflow cap that allows water to circumvent the overflow cap and to flow into the overflow assembly. The overflow cap of some embodiments of the present invention also employs prongs that engage a nut associated with the overflow assembly to provide the contemplated gap.

It is still yet another aspect of the present invention to provide a cable actuated drain assembly that employs a stopper with an anti-theft feature. More specifically, one embodiment provides a member that is selectively associated with the stopper that prevents complete removal therefrom the strainer to which the stopper is associated. Preferably, the anti-theft device is associated with the stopper without tools. This feature is desirable as stoppers are often stolen.

It is another aspect of the present invention to provide a cable actuated drain assembly wherein the finish therewith is easily changed. That is, often it is desirable to change bathtub finishes, i.e., those associated with the drain assemblies or overflow assembly to alter the aesthetic nature of one's bathroom or to repair components that have become broken or marred. Replacement, however, is often very difficult as the strainer must be disconnected from the plumbing system wherein the connection point is often located beneath the floor or the bathtub. Furthermore, conventional tools are typically insufficient to remove the strainer, and replacement often means that the plumbing system has to be rechecked for tests. This issue has been addressed by providing devices that are associated with the strainer to conceal the same. Similarly, embodiments of the present invention employ a retainer shield that conceals the nut associated with the overflow system of the cable actuated drain assembly. Embodiments of the present invention also employ an overflow cap and stop assembly that is replaceable.

In a related aspect of the present invention, embodiments of the present invention employ a common strainer body, which reduces inventory and facilitates repair or retrofit when the stopper assembly requires replacement.

It is another aspect of the present invention to provide a cable actuated drain assembly that is associated with flexible drain and overflow pipes. More specifically, it may be desirable to employ an overflow and drain assembly that includes flexible pipes to accommodate mismatches that occur during installation of the bathtub to the drain system of the dwelling. Such devices are taught by Applicant's U.S. patent application Ser. No. 12/100,762, which is incorporated by reference in its entirety herein. One skilled in the art will appreciate that such flexible piping may be used with the embodiments of the present invention without departing from the scope thereof.

It is still yet another aspect of the present invention to provide a stopper with a post, which may be either flexible or stiff. The stoppers used in conjunction with other embodiments described can be of any type. Preferably, embodiments of the present invention are used in conjunction with at least one of Applicant's Pressflow™, which is covered by U.S. Pat. Nos. 6,066,119 and 6,226,806, the lift/turn device described in U.S. Pat. No. 5,758,368 or push/pull device which is covered by U.S. Pat. No. 6,418,570, all of which are incorporated by reference herein. The push/pull and lift/turn stoppers are operably interconnected to the stopper that employs a post that moves relative to the strainer body. Embodiments of the present invention, however, replace the rigid post with a flexible post that allows the stopper to move freely but does not resist lateral loads, which will prevent injuries if the opened stopper is kicked, for example.

It is thus one aspect of the present invention to provide a system for controlling a drain stopper that includes an overflow assembly; a drain assembly, which includes said drain stopper, that is selectively moved relative to a strainer body to control the flow of fluid through the drain assembly; a cable drive shaft having a cam rotatably associated with said overflow assembly; a cable having a first end associated with said cam of said cable drive shaft and a second end associated with said drain assembly; a sheath associated with said overflow assembly and said drain assembly wherein said cable is positioned within an internal volume of said sheath and is able to slide freely therein; and wherein rotation of said cable driveshaft moves said cable within said sheath to thus move said second end of said cable from a first position of use to a second position of use to move said drain stopper relative to said strainer body.

It is yet another aspect of the present invention to provide a bathtub drain system comprising: a bathtub having an overflow port and a drain port; an overflow assembly that includes a threaded end with a flange spaced therefrom such that a portion of said overflow assembly is positioned outside the bathtub with said flange associated with an outer surface of said bathtub and wherein said threaded end is positioned within said overflow port with a portion thereof extending into said bathtub; a nut engaged onto said threaded portion of said overflow conduit that cooperates with said flange to firmly secure said overflow assembly to said bathtub, said nut also receiving an overflow cap that is adapted to rotate relative thereto; a drain assembly having a drain conduit with a flange that is associated with said outer surface of said bathtub, said drain conduit interconnected to a strainer body having an outwardly extending flange that cooperates with said flange of said drain conduit to interconnect said drain conduit to said bathtub, said strainer body also possessing an inwardly disposed hub for receipt of a hollow shaft that slidingly receives a post that is associated with a stopper that controls fluid flow through the drain conduit; a cable drive shaft having a cam rotatably associated with said overflow assembly; a cable having a first end associated with said cable retainer and a second end associated with said post; a sheath associated with said overflow assembly and said drain assembly wherein said cable is positioned within an internal volume of said sheath and is able to slide freely therein; and wherein rotation of said cable drive shaft moves said second end of said cable to selectively move said stopper to open and close said drain assembly.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
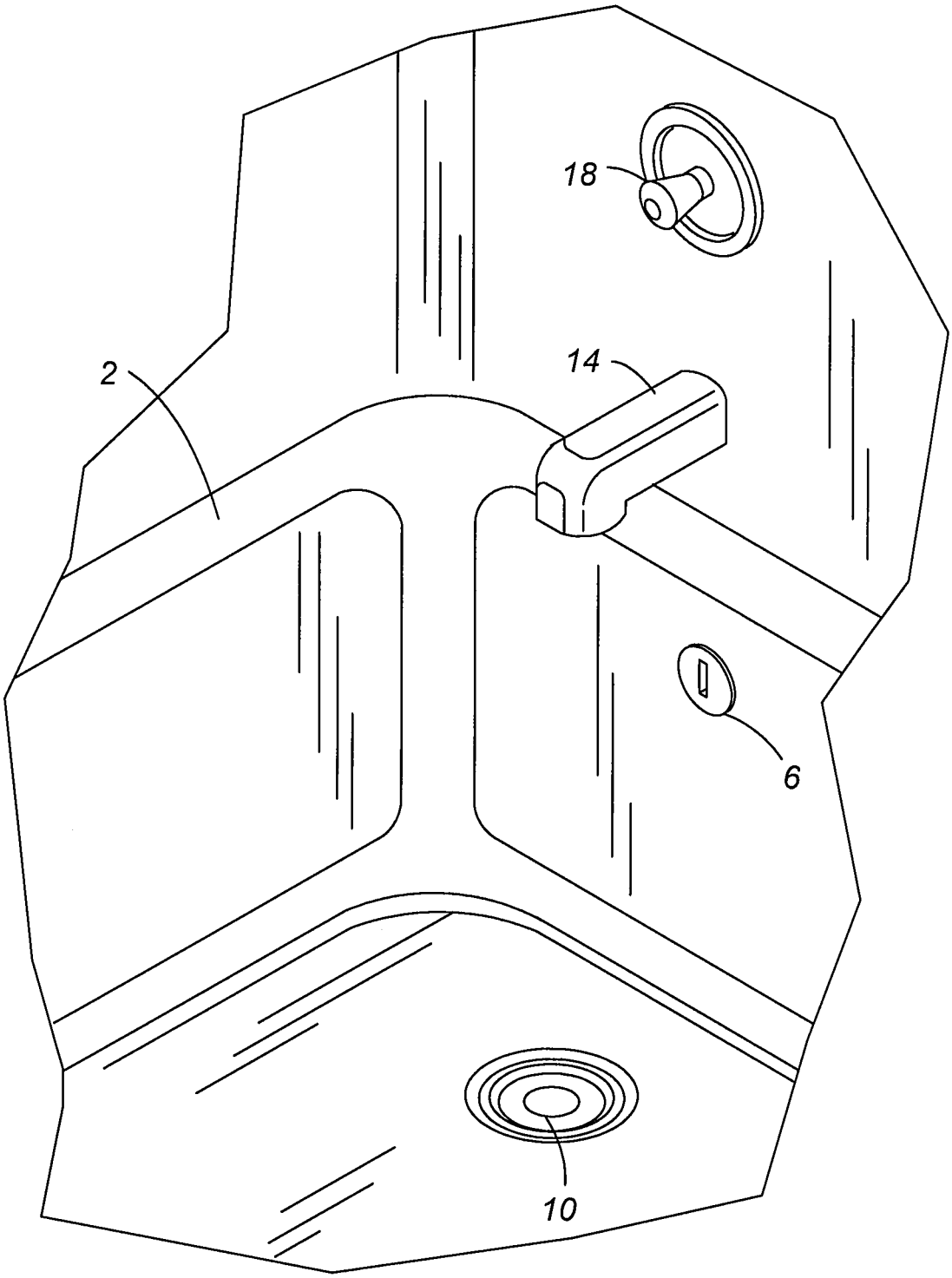
FIG. 1 is a partial perspective view of a bathtub assembly showing the overflow port and a drain port.

To assist in the understanding of the present invention the following list of components and associated numbering found in the drawings is provided herein:

| # | Components |
|---|---|
| 1 | Cable actuated drain assembly |
| 2 | Bathtub |
| 6 | Overflow port |
| 10 | Drain port |
| 14 | Water inlet |
| 18 | Knob |
| 20 | Overflow assembly |
| 22 | Overflow pipe |
| 24 | Drain assembly |
| 26 | Drain pipe |
| 30 | Overflow cap |
| 34 | Cable |
| 38 | Sheath |
| 42 | Post |
| 46 | Head |
| 50 | Overflow elbow |
| 54 | Overflow flange |
| 58 | Knob |
| 62 | Boss |
| 66 | Drain elbow |
| 70 | Drain flange |
| 74 | Seal |
| 78 | Strainer |
| 82 | Strainer flange |
| 86 | Boss |
| 90 | Threaded member |
| 94 | Seal |
| 98 | Nut |
| 102 | Plate |
| 106 | Shaft |
| 110 | Tapped hole |
| 114 | Screw |
| 118 | Fitting |
| 120 | Hub |

-continued

| # | Components |
|---|---|
| 122 | Linkage |
| 124 | Tapped hole |
| 126 | Diaphragm |
| 130 | Shaft |
| 134 | Bolt |
| 136 | Sidewall |
| 138 | Seal |
| 142 | Hub |
| 146 | Spring |
| 150 | Solenoid motor |
| 154 | Magnet |
| 158 | Primary drain |
| 162 | Tee |
| 200 | Cable actuated drain assembly |
| 204 | Overflow cap |
| 208 | Cable |
| 212 | Overflow assembly |
| 216 | Riser |
| 220 | Drain Assembly |
| 224 | Lower pipe |
| 228 | Tee |
| 232 | Easeway |
| 236 | Sheath |
| 240 | Insert |
| 244 | Insert |
| 248 | Washer |
| 252 | Nut |
| 256 | Strainer body |
| 260 | Washer |
| 264 | Cable drive |
| 268 | Cam |
| 272 | Cable retainer |
| 276 | Cable core anchor barrel |
| 280 | Adapter |
| 284 | Cable retainer shield skin |
| 288 | Stopper |
| 289 | Seal |
| 290 | First end |
| 294 | Second end |
| 298 | Elbow |
| 300 | Flange |
| 302 | Diaphragm |
| 306 | Prong |
| 310 | Stopper assembly |
| 314 | Pin |
| 318 | Adjustment screw |
| 322 | Guide |
| 326 | Second end |
| 330 | Anti-theft device |
| 334 | Hook |
| 338 | Clasp |
| 342 | Protrusion |
| 346 | Cavity |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIG. 1 shows a bathtub 2 having an overflow port 6 and a drain port 10. The bathtub 2 is filled with water by way of a water inlet 14 where a knob 18 is rotated.

Referring now to FIGS. 2-7, the cable actuated drain assembly 1 of one embodiment of the present invention is shown that employs an overflow assembly 20 with an overflow pipe 22 and a drain assembly 24 with a drain pipe 26. The overflow pipe 22, which may be flexible, includes a rotatable overflow cap 30 that is associated with a cable 34 situated in a sheath 38. The cable 34 is also associated with a post 42 of the drain assembly 24 wherein selective rotation of the cap 30 moves a head 46 of the drain assembly 24 from a first position of use to a second position of use and positions therebetween. In one embodiment rotation of the cap 30 about 70 degrees moves the head 46.

Figure 2:
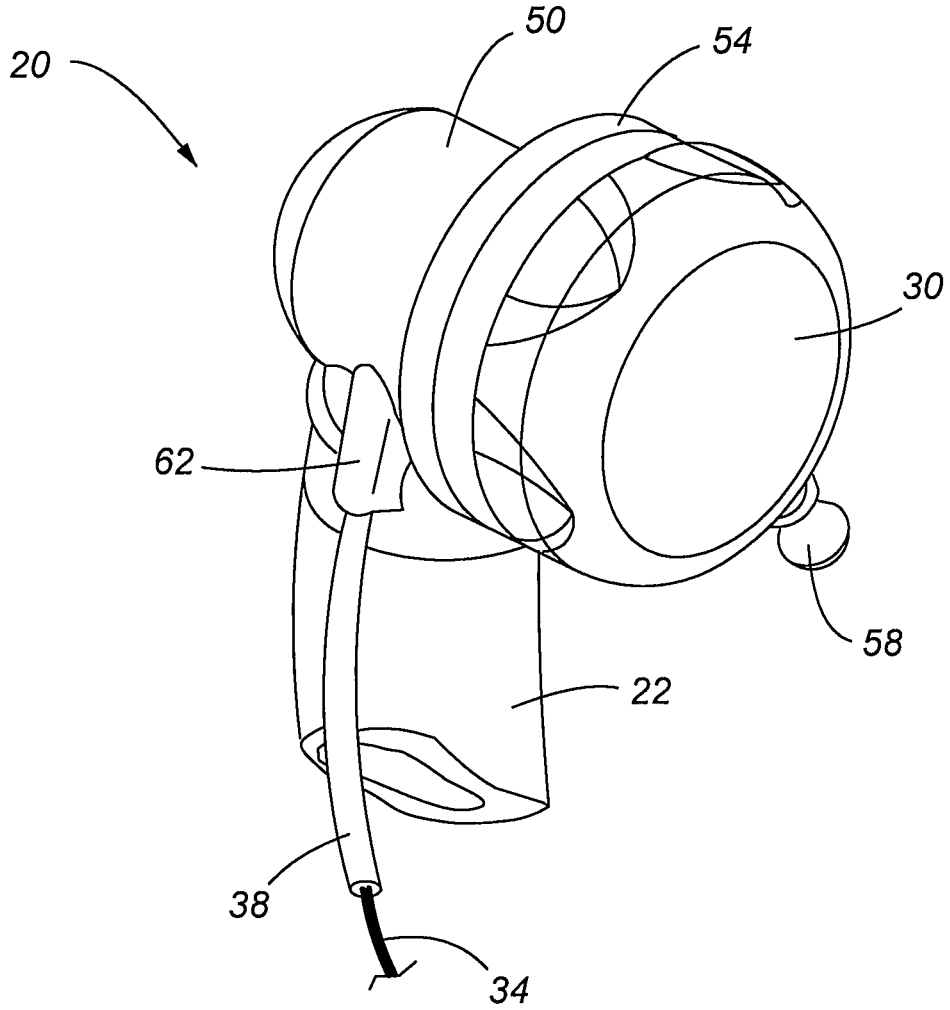
FIG. 2 is a partial perspective view of an overflow assembly of one embodiment of the present invention.
Figure 3:
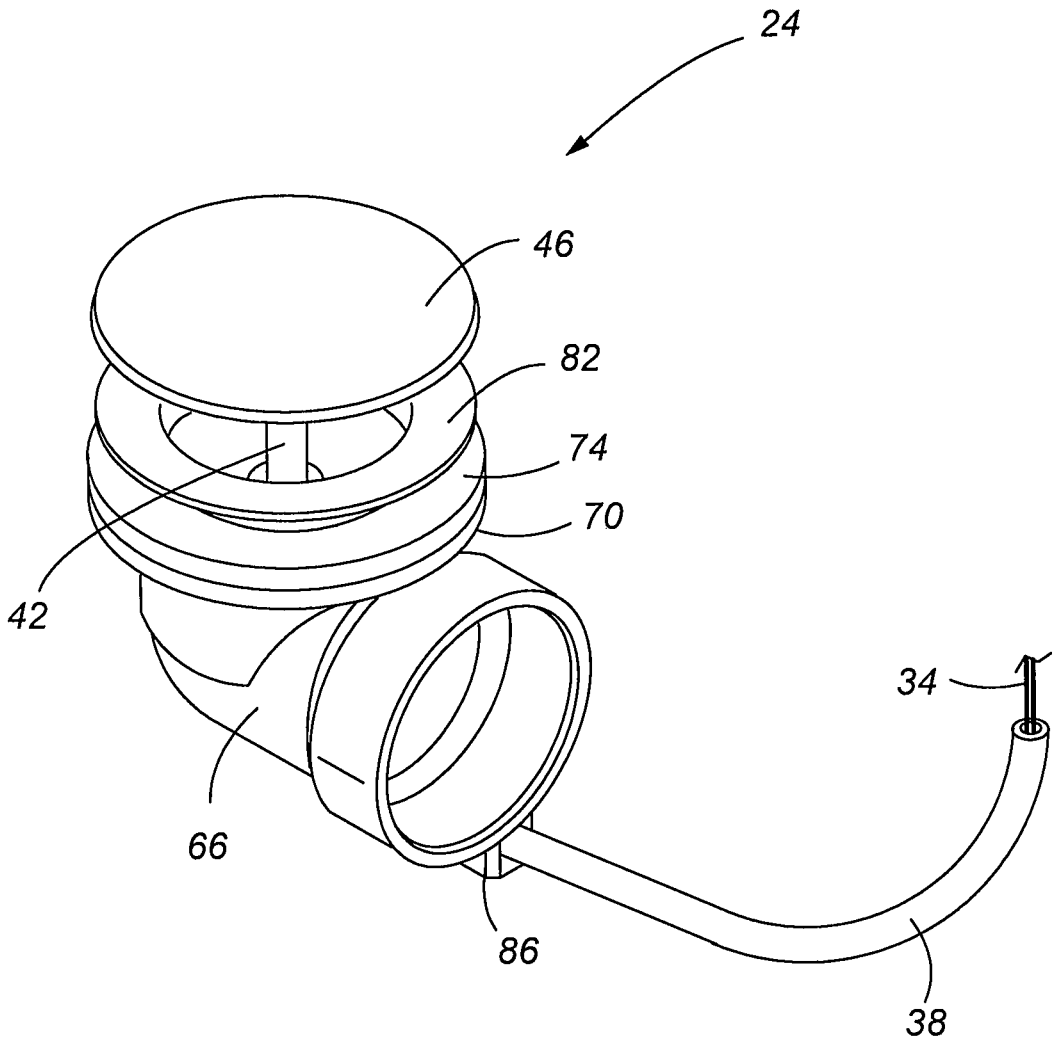
FIG. 3 is partial rear perspective view of a drain assembly of one embodiment of the present invention.

Referring now specifically to FIG. 2, the overflow assembly 20 is shown that is comprised of an overflow elbow 50 interconnected to the overflow pipe 22. The overflow elbow 50 also includes a flange 54 that is spaced from the overflow cap 30. The overflow cap 30 may also include a knob 58 positioned thereon that facilitates rotation of the cap 30 as well. The overflow elbow 50 also includes a boss 62 that is interconnected to the sheath 38 that slidingly houses the cable 34 therein.

Figure 4:
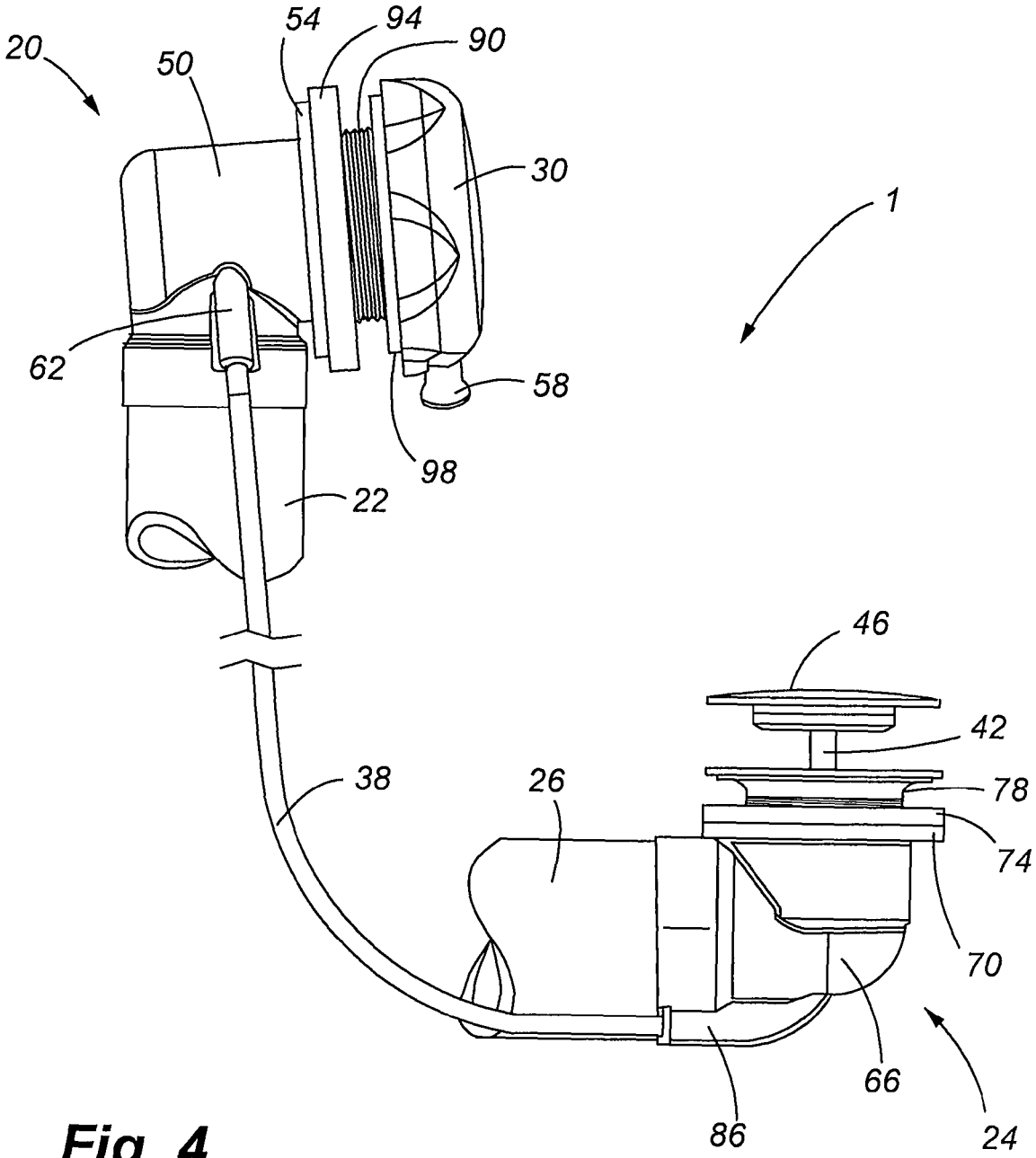
FIG. 4 is a partial left elevation view of the drain system of one embodiment of the present invention.
Figure 5:
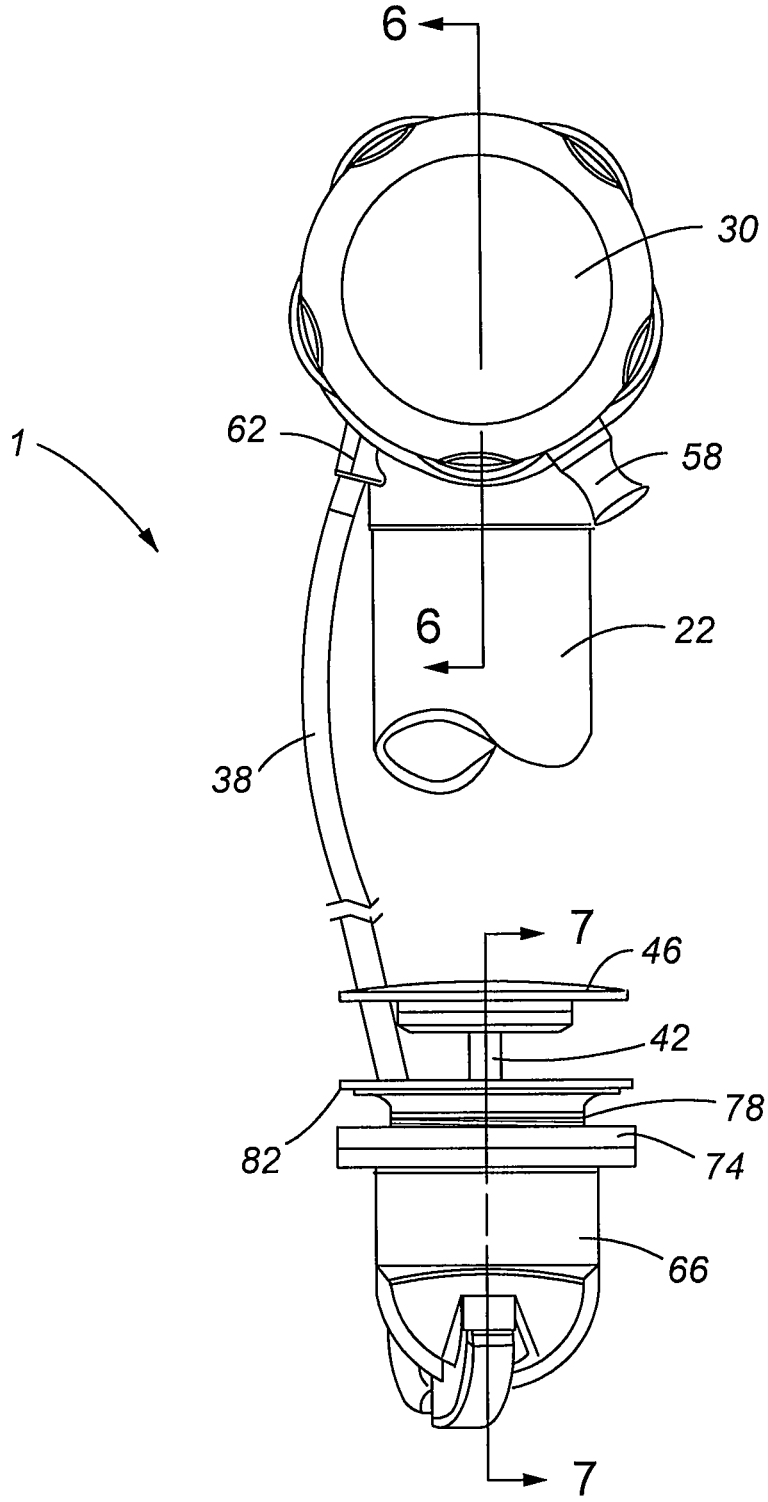
FIG. 5 is a front elevation view of FIG. 4.

Referring now to FIG. 4, the drain assembly 24 of one embodiments of the present invention is shown that includes a drain elbow 66 that is associated with a drain flange 70 on one end and a drain pipe on the other end (not shown). Embodiments of the present invention also include a seal 74 that is associated with the drain flange 70 and a strainer 78 that includes a strainer flange 82 (see FIG. 3) that is spaced from the seal 74. In operation, the strainer flange 82 and seal 74 cooperate to tightly engage the drain port of the bathtub. The drain assembly 24 includes the post 42 that is associated with the drain elbow 66 that has a head 46 that selectively moves away from the strainer flange 82 to allow water through the drain elbow 66 or against the strainer flange 82 to prevent water drainage through the drain assembly 24. In one embodiment, the head 46 moves about inches from the strainer flange 82. The drain assembly 24 also includes a boss 86 that receives the sheath 38 that holds the cable 34.

FIGS. 4-7 show the assembly of one embodiment of the present invention. Here, the overflow assembly 20 is associated with the drain assembly 24 via the overflow pipe 22 and the drain pipe 26. That is, one skilled in the art will appreciate that the overflow pipe 22 meets the drain pipe 26 at a tee connection that is also interconnected to a primary drain of a dwelling, the tee and the primary drain are not shown for clarity. The overflow assembly 22 also includes a threaded member 90 and a seal 94. The threaded member 90 is adapted to be placed within the overflow port of the bathtub wherein a nut 98 is interconnected thereto and used in conjunction with the seal 94 and overflow flange 54 to firmly attach the overflow assembly 20 to the bathtub. The cap 34 is then rotatably interconnected to the nut 98 and associated with the cable 34 residing within the sheath 38. Again, as discussed above, the drain assembly 24 includes the flange 70 and associated seal 74 that cooperates with the flange 82 of a strainer 78 to firmly secure the drain assembly 24 to the bottom portion of a bathtub.

Figure 6:
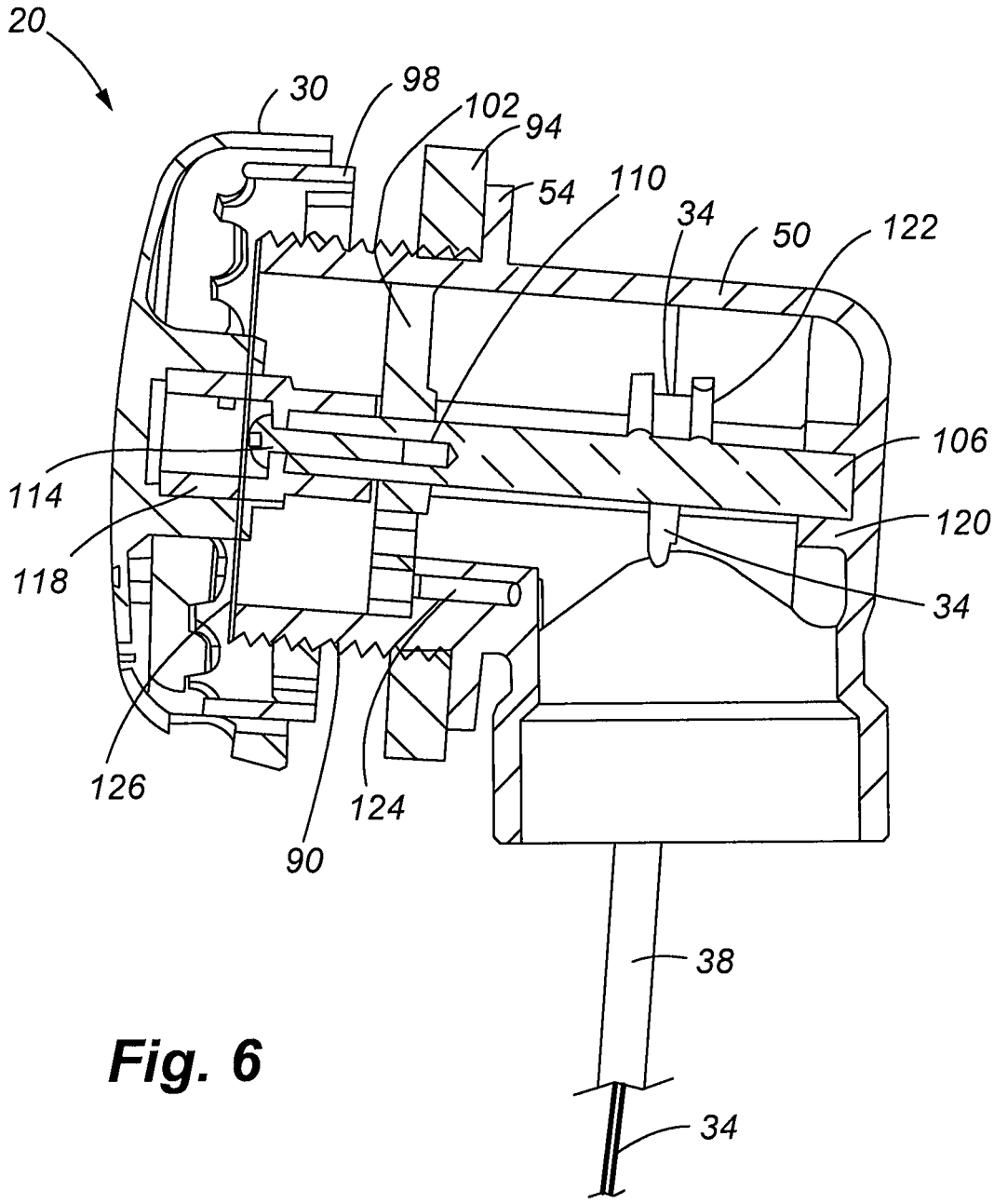
FIG. 6 is a cross-sectional view of the overflow assembly shown in FIG. 5.

Referring now specifically to FIG. 6, one embodiment of the present invention is shown wherein the overflow assembly 20 also includes a plate 102 that is situated within the overflow elbow 50. The plate 102 rotatably receives a shaft 106 that has a tapped hole 110 on one end for receiving a screw 114 that receives a fitting 118 and secures the fitting 118 to the shaft 106. The fitting 118 may be provided in various lengths or a shim may be used in conjunction with the fitting 118 to create sufficient spacing that allow fluid flow. The shaft 106 is also rotatably interconnected to a hub 120. The fitting 118 is a swage fitted to the overflow cap 30, such that rotation of the cap 30 will rotate the shaft 106. The shaft 106 includes a linkage 122, i.e., clevis, which is rotatably associated with the cable 34 such that the rotation of the shaft 106 will move one end of the cable 34 therearound which pulls the cable 34 relative to the sheath 38. The plate 102 may be secured to the inner portions of the overflow assembly via fasteners (not shown) that engage tapped holes 124 integrated into the overflow port. FIG. 6 also shows that the threaded portion 90 of the overflow elbow 50 may be capped with a thin diaphragm 126, which will be described in further detail below.

Figure 7:
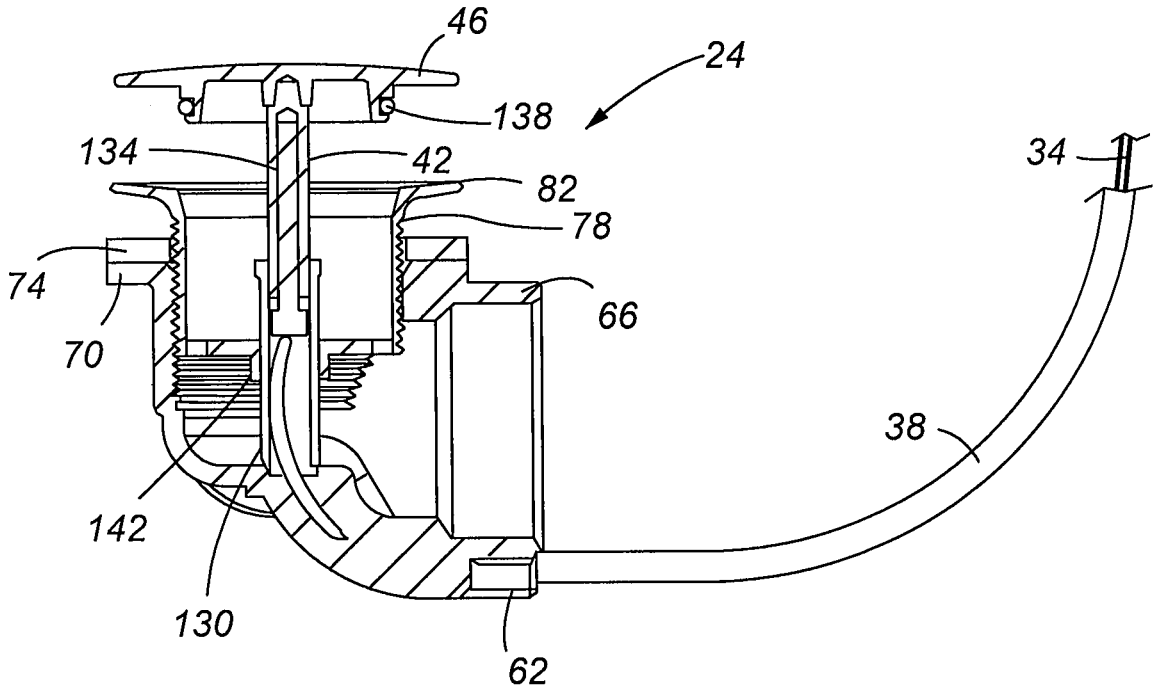
FIG. 7 is a cross-sectional view of the drain assembly shown in FIG. 6.

Referring now to FIG. 7, the drain assembly 24 of one embodiment of the present invention is shown. The drain assembly 24 includes a shaft 130 that is slidingly associated with the post 42 and preferably is hollow and provides a location of a bolt 134. The end of the cable 34 resides within the shaft 130 and contacts the end of the post 42 or the bolt 134 as shown. In operation, the bolt 134 may be used to selectively lengthen or shorten the length of the post 42 to allow for a minute adjustment of the closing operation of the cable 34. The head 46 of the drain assembly 24 may also include a sidewall 136 that receives a seal 138 to facilitate the blocking of the strainer 78. The shaft 130 is threadingly engaged, slidingly engaged or interference fit onto a hub 142 of the strainer 78.

Figure 8:
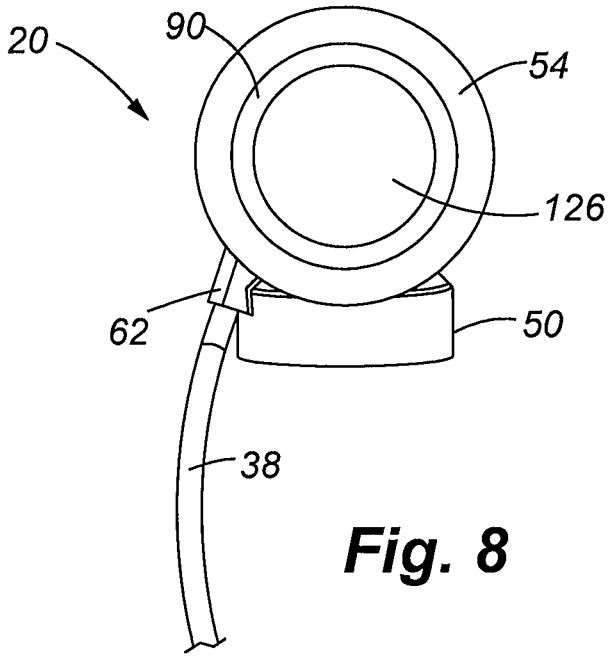
FIG. 8 is a front elevation view of an overflow assembly employing a diaphragm.
Figure 9:
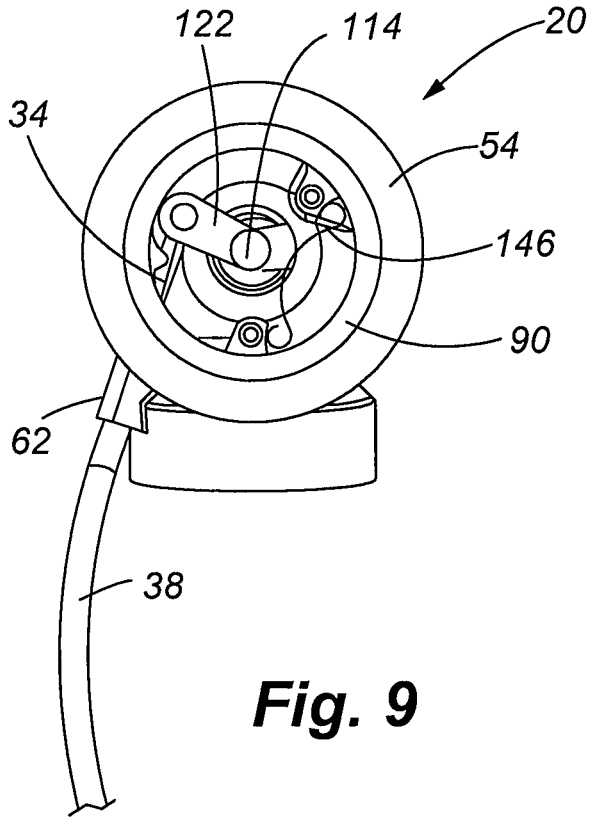
FIG. 9 is a front elevation view of an overflow assembly employing a diaphragm after removal thereof.

Referring now to FIGS. 8 and 9, one embodiment of the present invention is shown that allows for selective testing of the plumbing system is shown. Here, the overflow assembly 20 includes a thin diaphragm 126 associated with an end thereof, a threaded portion 90, for example. As such, fluids are prevented from passing through the overflow assembly 20. After testing is completed, that portion of the overflow assembly is removed to allow water through the overflow assembly 20. One of skill in the art will appreciate that any device for selectively restricting flow through the overflow assembly may be provided, such as a cap, without departing from the scope of the invention.

FIG. 9 shows the linkage 122 that is associated with the shaft 106. The overflow assembly 20 may also include a spring 146, such as a leaf spring, that is associated with the inner portion of the overflow assembly 124. The spring 146 reacts loads from the linkage 122 if the device is turned too far and facilitates the return of the linkage 122, and thus the cable 34, to its first position of use, which aids in moving the head of the drain assembly. The spring of some embodiments of the present invention may be integrated, i.e. molded, directly into the plate 102. One of skill in the art will appreciate that the spring, or other biasing device, may not be required wherein the cable/sheath combination may possess sufficient frictional interaction to provide the contemplated recoil.

FIGS. 6 and 9 also illustrate to one skilled in the art in that the components of the system are readily accessible and easily replaced. That is, all of the components associated with moving the linkage 122 and the cable 34 may be replaced by removing the cover and/or diaphragm 126 of the overflow assembly. For example, the screw 114 may be removed to gain access to the plate 102 and the linkage 122 and associated shaft 106. The cable 34, which is rotatably associated with one end of the linkage 122, may also be removed from the sheath 38 and replaced. As shown in FIG. 7, the other end of the cable 34 would then be abutted against the bolt 134 of the drain assembly 24. Adjusting the location of the bolt 134 situated within the post 42 (i.e., by tightening or by loosening) will affect the interplay between the cable 34 and the head 46.

Figure 10:
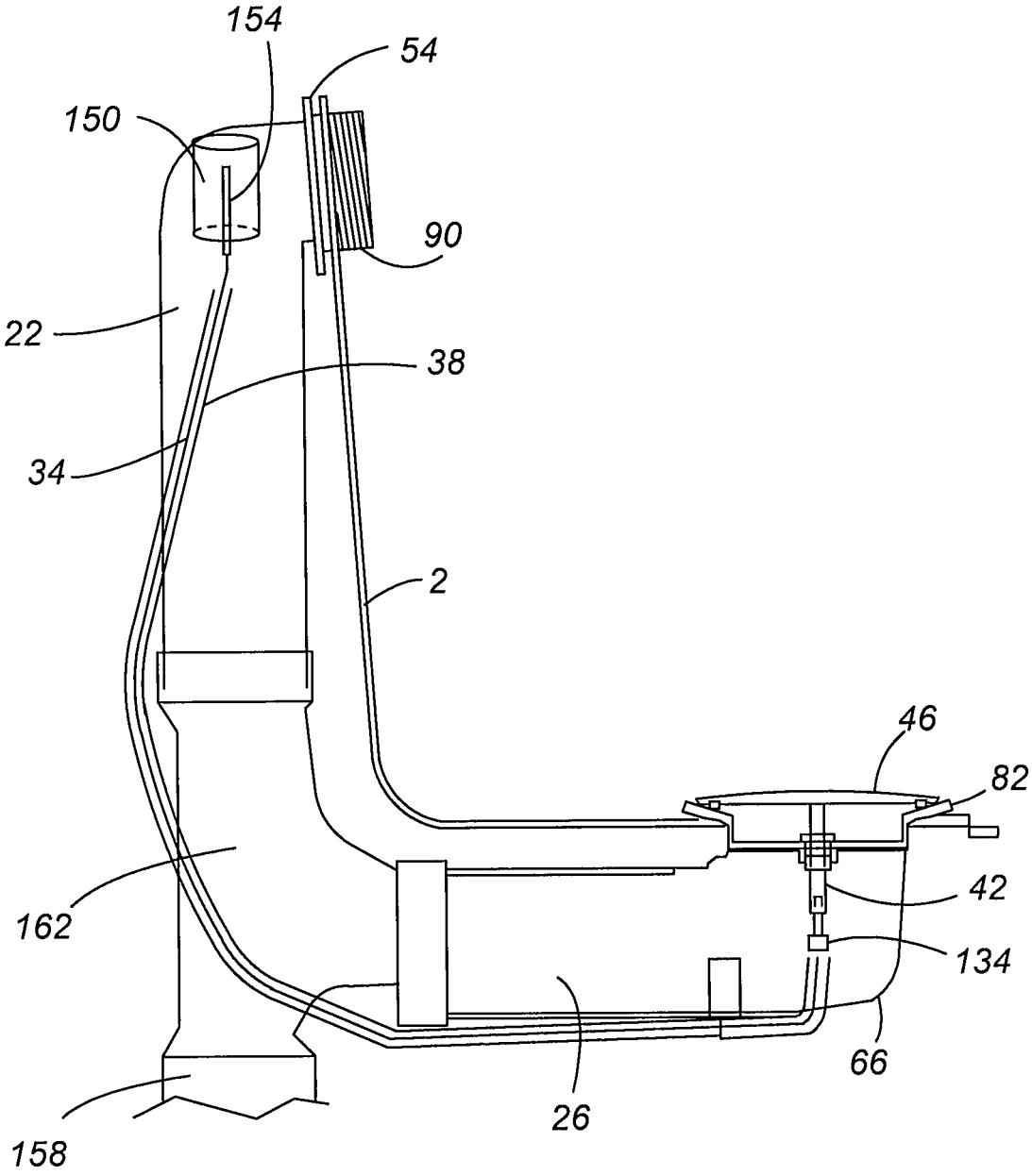
FIG. 10 is a left elevation view of an alternative embodiment of the present invention.

Referring now to FIG. 10, an alternative embodiment of the present invention is shown. Here, a solenoid motor 150 is employed that is associated with one end of the cable 34. In operation, one would depress a button, twist a knob, flip a switch, or trip a motion-activated switch, for example, to activate the solenoid 150 by creating a magnetic field that would pull magnetic portion 154 of the cable 34. By pulling or pushing such magnet 154, the cable 34 situated within the sheath 38 moves relative thereto to actuate the drain system of the plumbing system. One skilled in the art will appreciate that the solenoid motor can be placed anywhere within the plumbing system as long as access thereto is provided without an access panel. For example, the solenoid may be associated with the elbow of the drain, thereby reducing the length of the cable or eliminating the same. In addition, a servo motor may be employed as opposed to the contemplated solenoid.

Referring now to FIGS. 11-15, another embodiment of the cable actuated drain assembly 200 is shown that is similar to that of FIGS. 1-9, but employs a slightly altered overflow cap 204 and associated assembly that controls the movement of the cable 208. More specifically, the cable actuated drain assembly 200 employs an overflow assembly 212, which is interconnected to a riser 216, and a drain assembly 220, which is interconnected to a lower pipe 224. The lower pipe 224 and the riser 216 meet at a tee 228. The overflow assembly 212 includes a raceway 232 that is associated with a sheath 236 that covers the cable 208. The sheath 236 is interconnected to the raceway 232 by a quick connect insert 240 and a plurality of o-rings, the sheath 236 may be welded to the raceway 232. The other side of the cable 208 is interconnected to the raceway 232 of the drain assembly 200 by way of an insert 244 and a plurality of o-rings. One of skill in the art will appreciate that other interconnection methods could be used. As above, the overflow assembly 212 employs a washer 248 and a nut 252 that affixes the overflow assembly 212 to the bathtub (not shown). Similarly the drain assembly 220 functions in conjunction with the strainer body 256 and a washer 260 to affix the same to the bathtub.

Figure 11:
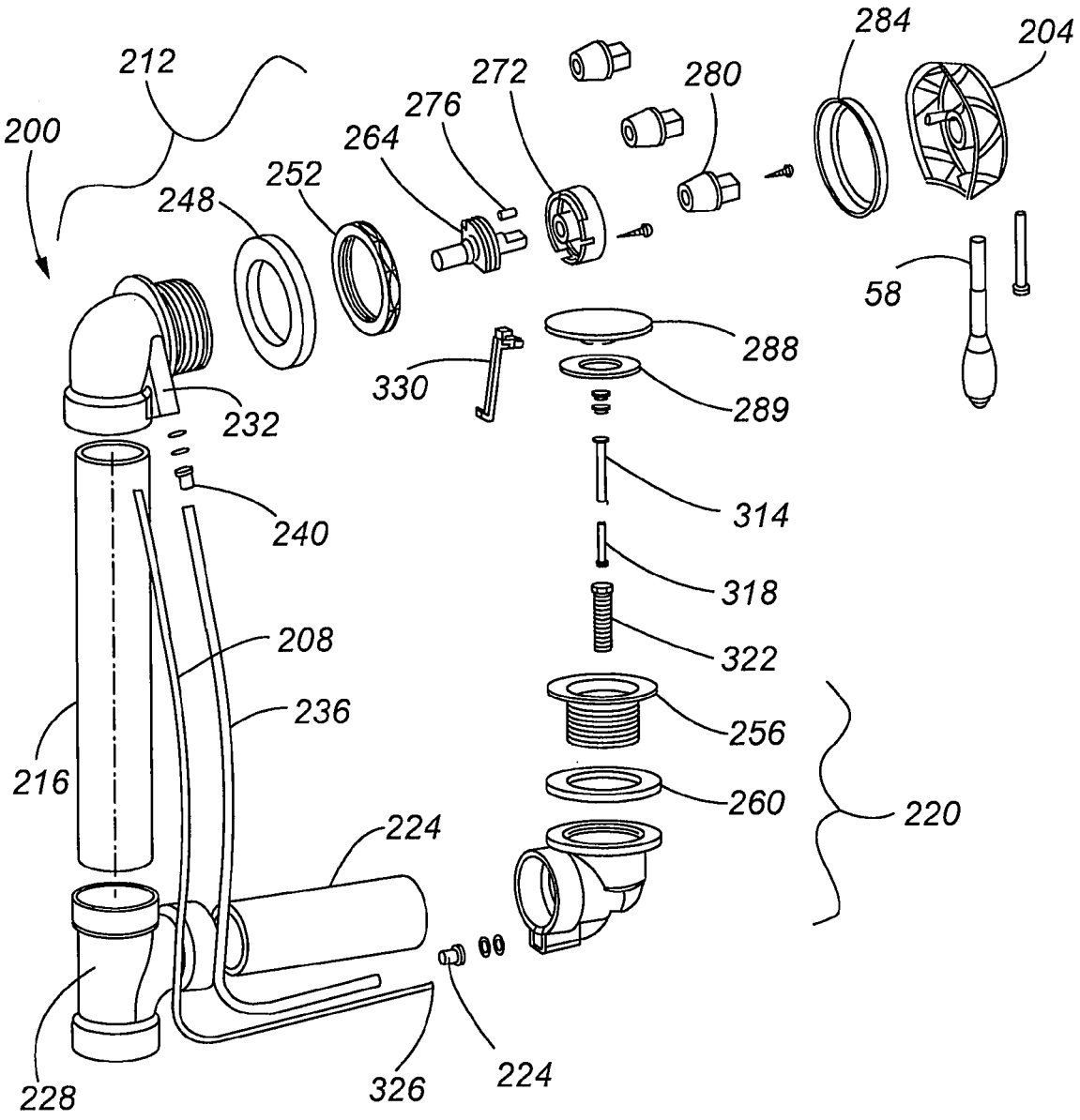
FIG. 11 is an exploded perspective view of the cable actuated drain assembly of another embodiment of the present invention.
Figure 12:
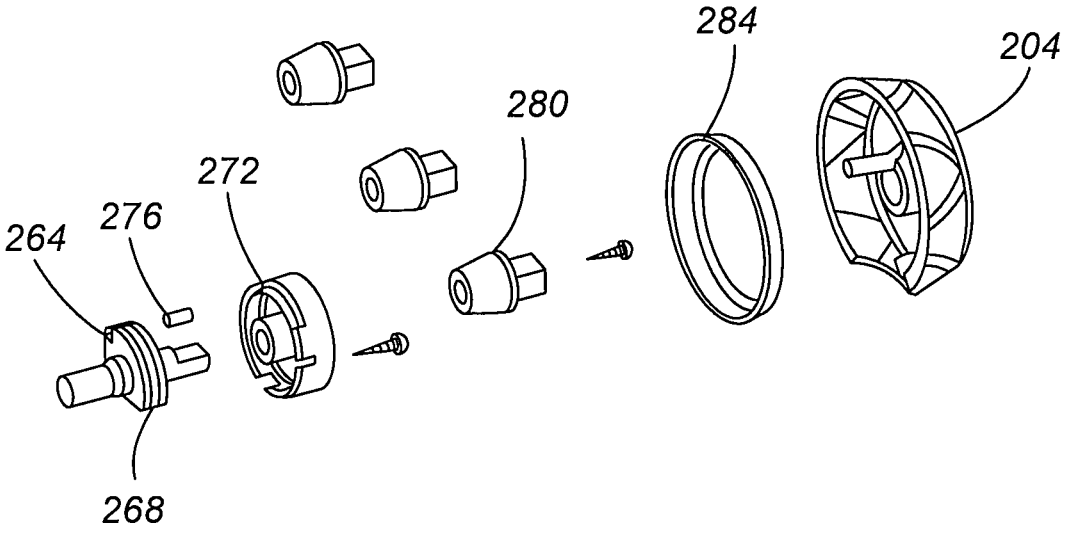
FIG. 12 is a detail of FIG. 11.
Figure 12A:
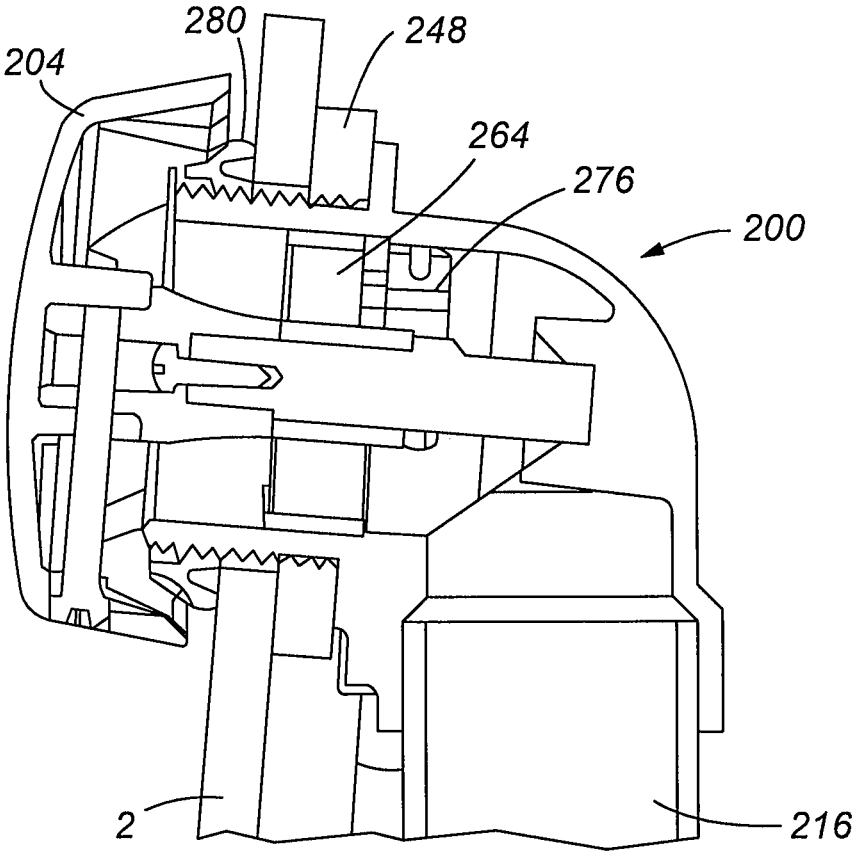
FIG. 12A is a cross-sectional view of the overflow assembly shown in FIG. 11.

With specific reference to FIGS. 11-12A, the one difference between this embodiment and those described above is the mechanism by which the cable 208 is moved. Here, a cable drive 264 having a cam 268 is employed that is associated with a cable retainer 272. The cable 208 is associated with the cable retainer 272 and held in place by a cable cord anchor barrel 276. A plurality of adapters 280 are used to space the overflow cap 204 from the tub 2. A cable retainer shield skin 284 is used to cover the nut 252. The overflow cap 204 is interconnected to the cable retainer 272 wherein rotation of the overflow cap 204 will provide rotation of the cable retainer 272 and associated cable drive 264, thereby pulling the cable 208 around the cam 268 and actuating a stopper 288 and associated seal 284 as described above.

Figures 13A, 13B:
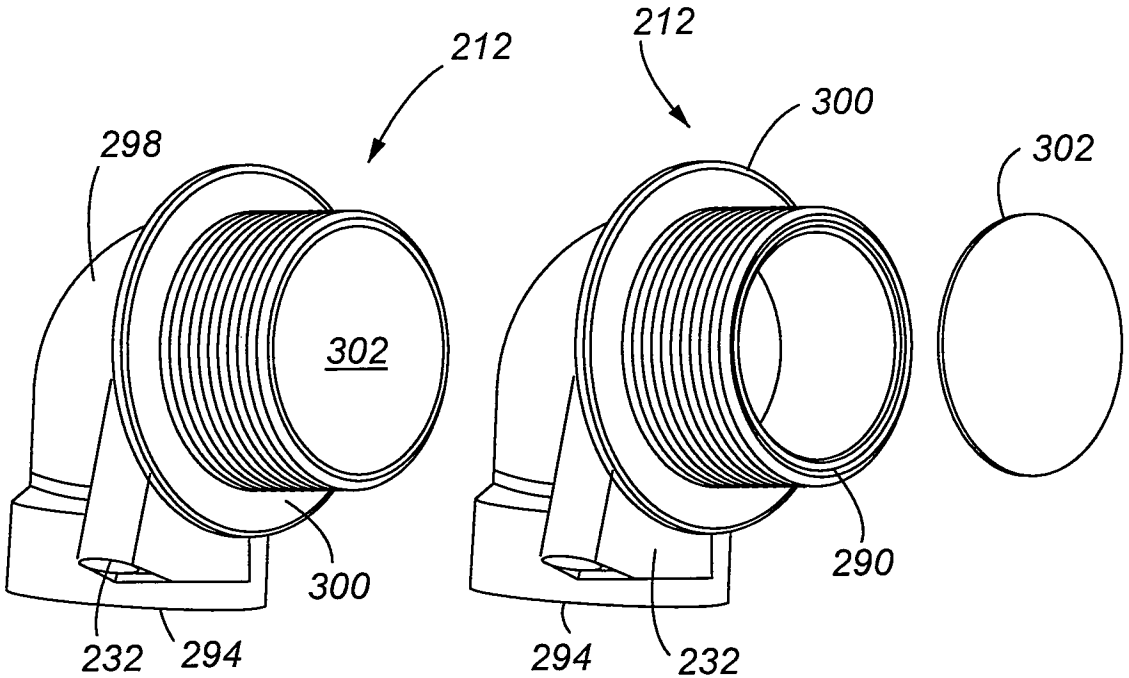
FIG. 13A is a perspective view of the overflow conduit employed by some embodiments of the present invention.
FIG. 13B is a perspective view of the overflow conduit employed by some embodiments of the present invention.

Referring now to FIG. 13, the overflow assembly 212 with multiple embodiments of the present invention is shown. The overflow assembly 212 employs a first end 290 and a second end 294 with an elbow 298 therebetween. A flange 300 is positioned between the elbow 298 and the first end 290. The first end 290 is associated with a diaphragm 302 that is either cut or peeled or otherwise removed from the first end 290 to provide a fluid flow path through the overflow assembly 212. The overflow assembly 212 is interconnected to a cable raceway 232 that receives the sheath and the cable therein (not shown). The diaphragm 302 is used during a test where the plumbing system of a dwelling is filled with fluid and test for leakage. Thereafter, the diaphragm 302 may be removed to provide a fluid flow path through the overflow assembly 212. One skill in the art will appreciate that a cap, or any other obstruction, may be used instead of the diaphragm 302 (or 126 of FIG. 8).

Figure 14:
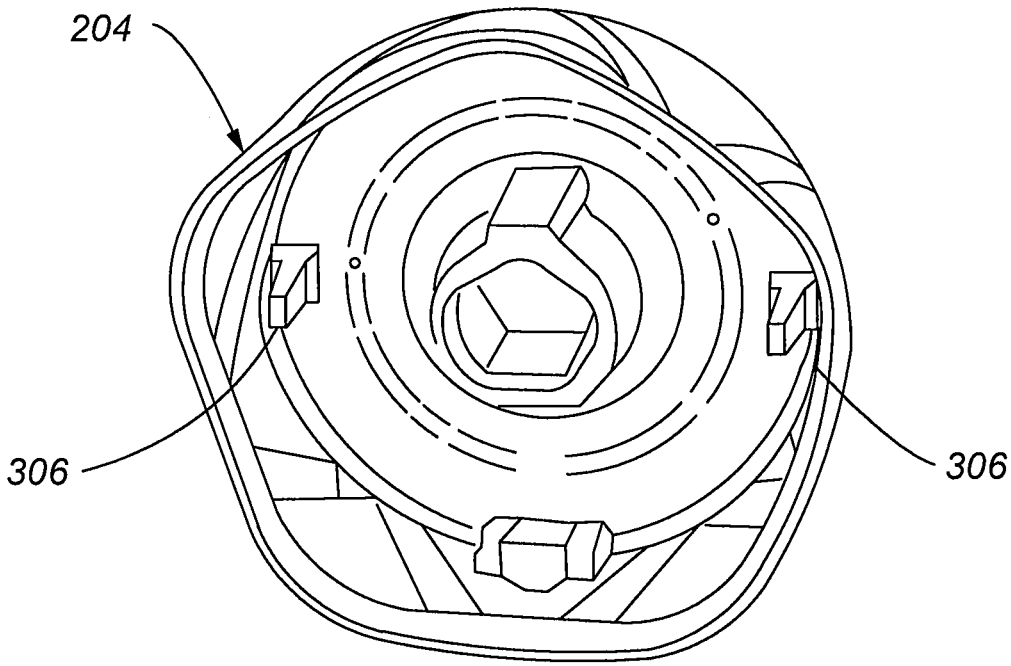
FIG. 14 is a rear perspective view of an overflow cap of the embodiment of the present invention shown in FIG. 11.
Figure 15A:
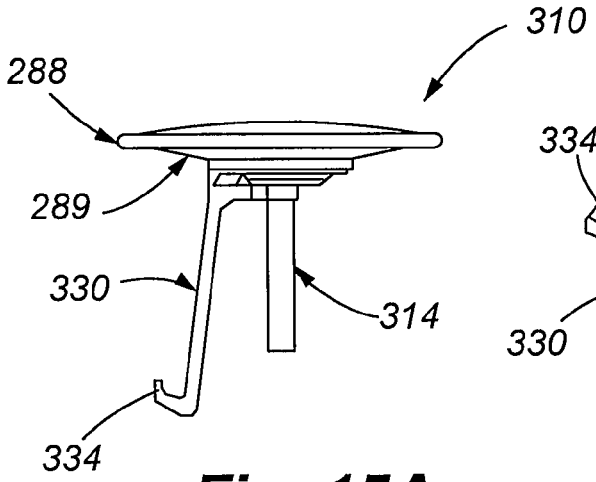
FIG. 15A is a front elevation view of a stopper that is used in conjunction with anti-theft device of one embodiment of the present invention.
Figure 15C:
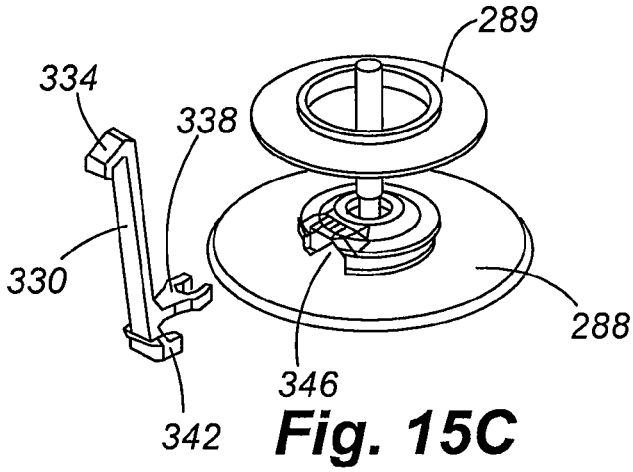
FIG. 15C is a bottom perspective view of a stopper that is used in conjunction with anti-theft device of one embodiment of the present invention.
Figure 15B:
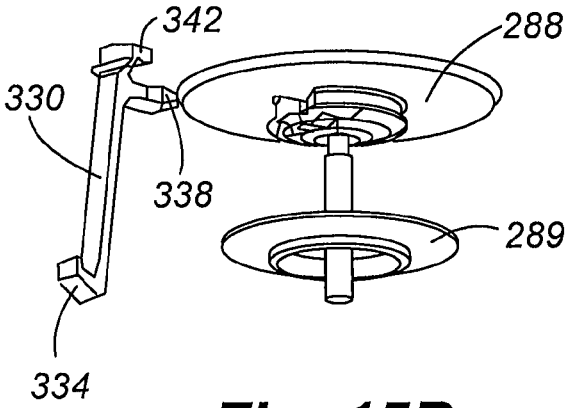
FIG. 15B is a top perspective view of a stopper that is used in conjunction with anti-theft device of one embodiment of the present invention.
Figure 15D:
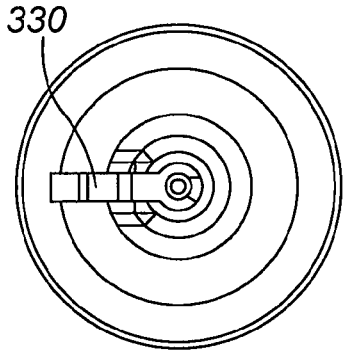
FIG. 15D is a bottom plan view of a stopper that is used in conjunction with anti-theft device of one embodiment of the present invention.

Referring now to FIG. 14, the overflow cap 204 is shown that may be of any shape or design and is interconnected to the cable retainer to impart rotational motion thereto. A plurality of prongs 306 are provided that space the overflow cap 204 from the tub to allow fluid flow therearound and into the overflow assembly. The overflow cap 204 is easily replaceable and may be made of common finish material, such as chrome plated plastic, for example.

Referring now to FIGS. 11 and 15*a*-15*d*, the stopper assembly 310 employed by one embodiment of the present invention is shown that includes the stopper 288 and the associated seal 289. A pin 314 is interconnected to the stopper 288 and accommodates an adjustment screw 318 as described above. The cable 208 includes a guide 322 interconnected to a second end 326 thereof that interacts with the adjustment screw 318 to provide forces required to lift and lower the stopper 288. Additionally, an anti-theft device 330 may be associated with the pin 314. The anti-theft device 330 employs a hook 334 that interacts with a cross member commonly associated with a strainer body 256 that prevents complete removal of the stopper assembly 310 from the strainer body 256. The anti theft device 330 may employ a resiliently deflectable clasp 338 that grasps the pin 314. In addition, a protrusion 342 that is received within a cavity 346 associated with the stopper 288. The anti-theft device may extend through a hair strainer associated with the horizontal flange of the strainer.

The embodiments of the present invention disclosed herein may be incorporated with the inventions described in U.S. Pat. No. 5,590,679 entitled "Wall Water Hydrant Having Backflow and Back Siphonage Preventor", U.S. Pat. No. 5,692,248 entitled "Method and Means for Covering the Flange of a Waste Water Strainer", U.S. Pat. No. 5,745,931 entitled "Method and Means for Covering the Flange of a Waste Water Strainer", U.S. Pat. No. 5,758,368 entitled "Waste Water Valves For Bathtubs and the Like", U.S. Pat. No. 5,890,241 entitled "Method and Means for Installing Overflow Outlets to Bathtubs and the Like", U.S. Pat. No. 6,066,119 entitled "Waste Water Strainer and Valve", U.S. Pat. No. 6,138,298 entitled "Clip on Fluid Overflow Plate for Bathtubs", U.S. Pat. No. 6,142,172 entitled "Freeze Prevention Device for Wall Hydrants/Faucets", U.S. Pat. No. 6,148,454 entitled "A Solenoid Control for a Bathtub Waste Water Drain", U.S. Pat. No. 6,154,898 entitled "Waste Water Drain Control for Fluid Compartments", U.S. Pat. No. 6,173,459 entitled "A Control For a Bathtub Waste Water Drain", U.S. Pat. No. 6,226,806 entitled "Waste Water Strainer and the Like", U.S. Pat. No. 6,317,906 entitled "Strainer Assembly for Bathtub Drains and the Like", U.S. Pat. No. 6,418,570 entitled "Drain Closure", U.S. Pat. No. 6,431,204 entitled "Solenoid Actuated Wall Hydrant", U.S. Pat. No. 6,546,573 entitled "Drain Cover Assembly", U.S. Pat. No. 6,637,050 entitled "Overflow Assembly for Bathtubs and the Like", U.S. Pat. No. 6,640,358 entitled "Strainer Assembly for Bathtub Drains and the Like", U.S. Pat. No. 6,675,406 entitled "Overflow Assembly for Bathtubs and the Like", U.S. Pat. No. 6,675,407 entitled "Solenoid Activated Bathtub Drain Closure", U.S. Pat. No. 6,681,420 entitled "Method and Apparatus for Installing a Bathtub Assembly", U.S. Pat. No. 6,691,411 entitled "Method of Installing a Waste Water Drain Assembly for a Bathtub", D521,113 entitled "Hydrant Handle Design", U.S. Pat. No. 7,127,752 entitled "Overflow Assembly for Bathtubs and The Like", U.S. Pat. No. 7,185,529 entitled "Shower Station Testing Assembly For Pressure Testing Plumbing", U.S. Pat. No. 7,451,502 entitled "Bath Drain Closure Assembly", and U.S. Pat. No. 7,503,083 entitled "U.S. Pat. "Means for Covering the Flange of a Waste Water Strainer", which are incorporated by reference herein.

The embodiments of the present invention disclosed herein may be incorporated with the inventions described in U.S. patent application Ser. No. 10/732,726 entitled "Method and Apparatus for Assembling and Sealing Bathtub Overflow and Waste Water Ports", Ser. No. 11/466,167 entitled "Control for a Bathtub Waste Water Drain", Ser. No. 11/161,866 entitled "Bath Drain Closure Assembly", Ser. No. 12/100,762 entitled "U.S. CIP Pat. "Flexible Bathtub Waste Pipe Assembly for Bathtubs and the Like", Ser. No. 12/057,660 entitled "U.S. CIP Pat. "Overflow Assembly for Bathtubs and the Like", Ser. No. 12/649,717 entitled "U.S. Pat. "Drain Closure Device", Ser. No. 11/931,681 entitled "U.S. Pat. "Method and Associated Apparatus for Assembling and Testing a Plumbing System", which are incorporated by reference herein.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that such modifications and alterations are within the scope and spirit of the present invention, as set forth in the following claims.

What is claimed is:

1. A system for selectively opening and closing a drain stopper, comprising:

an overflow assembly;

a drain assembly, which includes a flexible overflow pipe and a drain stopper that is selectively moved relative to a strainer body to control the flow of fluid through the drain assembly, said strainer body possessing an inwardly-disposed hub for receipt of a hollow shaft that slidingly receives a post that is associated with said drain stopper;

a cable drive shaft having a cam rotatably associated with said overflow assembly; and a cable having a first end associated with said cam of said cable drive shaft and a second end that is positioned within said hollow shaft and directly engaged with said post.

2. The system of claim 1, further comprising an overflow cap rotatably associated with said overflow assembly and interconnected to a cable retainer that is associated with said cable drive shaft wherein rotation of said overflow cap rotates said cable drive shaft.

3. The system of claim 2, wherein rotation of said overflow cap about 70 degrees moves said drain stopper from said strainer body to permit fluid flow through said drain assembly.

4. The system of claim 2, wherein said overflow cap further comprises a knob that facilitates rotation thereof.

5. The system of claim 1, wherein said post is flexible.

6. The system of claim 1, wherein said post accommodates an adjustment screw that is selectively interconnected thereto on an end opposite said drain stopper, and said second end of said cable being directly associated with said adjustment screw.

7. The system of claim 1, wherein said overflow assembly is associated with a flexible riser and said drain assembly is associated with a flexible lower pipe, said flexible riser and said flexible lower pipe are also interconnected to a tee.

8. The system of claim 1, wherein said cam comprises a channel that receives said cable and a cavity that receives a barrel that is associated with said first end of said cable.

9. A bathtub drain system comprising:

a bathtub having an overflow port and a drain port;

an overflow assembly that includes a flange that is associated with an outer surface of said bathtub and a flexible overflow pipe;

a drain assembly having a drain conduit with a flange that is associated with said outer surface of said bathtub, said drain conduit interconnected to a strainer body having an outwardly extending flange that cooperates with said flange of said drain conduit to interconnect said drain conduit to said bathtub, said strainer body also possessing an inwardly disposed hub for receipt of a hollow shaft that slidingly receives a post that is associated with a stopper that controls fluid flow through the drain conduit;

a cable drive shaft having a cam rotatably associated with said overflow assembly;

a cable having a first end associated with said cable retainer and a second end that is positioned within said hollow shaft and directly engaged onto said post.

10. The system of claim 9, further comprising a cable retainer skin that conceals said nut.

11. The system of claim 9, further comprising a diaphragm associated with the threaded end of said overflow assembly.

12. The system of claim 9, wherein said overflow assembly includes a raceway and said drain assembly includes a raceway, the raceways receiving the ends of a sheath that contains said cable.

13. The system of claim 9 also comprises an anti-theft device that is associated with said stopper and said strainer body.

14. The system of claim 13 wherein said anti-theft device is an angled member comprising:

a first end that terminates in a clasp that is interconnected to said post adjacent said stopper; and a second end that terminates in a hook that is adapted to selectively engage a portion of said strainer body to restrict movement of said stopper.

* * * * *